US012187565B2

(12) United States Patent
Borchert et al.

(10) Patent No.: US 12,187,565 B2
(45) Date of Patent: Jan. 7, 2025

(54) INKJET SHEET PRINTER WITH A SHEET STACKER COMPRISING A SHEET FLIPPING DEVICE

(71) Applicant: Canon Production Printing Holding B.V., Venlo (NL)

(72) Inventors: Christopher J. Borchert, Venlo (NL); Peter J. W. Van Dongen, Venlo (NL); Hermanus M. Kuypers, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 112 days.

(21) Appl. No.: 18/115,980

(22) Filed: Mar. 1, 2023

(65) Prior Publication Data

US 2023/0286768 A1 Sep. 14, 2023

(51) Int. Cl.

| | |
|---|---|
| ***B65H 29/40*** | (2006.01) |
| ***B65H 15/00*** | (2006.01) |
| ***B65H 29/06*** | (2006.01) |
| ***B65H 43/00*** | (2006.01) |

(52) U.S. Cl.

CPC ..... *B65H 29/40* (2013.01); *B65H 15/004* (2020.08); *B65H 29/06* (2013.01); *B65H 43/00* (2013.01); *B65H 2301/33214* (2013.01); *B65H 2301/33224* (2013.01); *B65H 2404/1114* (2013.01); *B65H 2404/652* (2013.01); *B65H 2511/20* (2013.01); *B65H 2511/22* (2013.01); *B65H 2513/10* (2013.01); *B65H 2513/11* (2013.01); *B65H 2515/81* (2013.01); *B65H 2801/06* (2013.01)

(58) Field of Classification Search

CPC .... B65H 29/40; B65H 29/06; B65H 2515/81; B65H 2301/33214; B65H 2301/33224; B65H 2404/1114; B65H 15/004; B65H 2513/10; B65H 2513/11

See application file for complete search history.

(56) References Cited

U.S. PATENT DOCUMENTS

| | | | | |
|---|---|---|---|---|
| 5,803,705 | A * | 9/1998 | Keyes | B65H 29/40 414/794 |
| 7,017,900 | B2 | 3/2006 | Dobrindt | |
| 2005/0258589 | A1 | 11/2005 | Michler et al. | |

OTHER PUBLICATIONS

Search Report issued in European priority application 22161173.4, dated Aug. 29, 2022.

* cited by examiner

*Primary Examiner* — Jeremy R Severson

(74) *Attorney, Agent, or Firm* — Birch, Stewart, Kolasch & Birch, LLP

(57) ABSTRACT

To prevent deformation to relatively stiffer sheets during flipping, while ensuring reliable holding of relatively weaker sheets, a method for stacking sheets received from a printer by a sheet flipping device includes at least one slot for receiving a leading portion of a sheet. The method includes determining a respective insertion depth parameter for a first and a second sheet, wherein the second sheet has a greater stiffness than the first sheet; inserting a length of the first sheet into the at least one slot in correspondence with its respective insertion depth parameter, followed by flipping said first sheet; inserting a length (D2) of the second sheet into the at least one slot in correspondence with its respective insertion depth parameter, followed by flipping said second sheet, wherein the inserted length of the first sheet is greater than that of the second sheet.

15 Claims, 3 Drawing Sheets

INKJET SHEET PRINTER WITH A SHEET STACKER COMPRISING A SHEET FLIPPING DEVICE

BACKGROUND OF THE INVENTION

1. Field of the Invention

The invention relates to a method for stacking sheets received from a printer, a sheet stacker, and a printer comprising such a sheet stacker.

2. Description of Background Art

Sheet stackers are applied in printers to form stacks of printed sheets. Certain sheet stackers are provided with a flipping device comprising at least one slot for receiving a leading portion of a sheet. The flipping device rotates the slot with the sheet in it, which results in a flipping motion of the sheet. Thereby the surfaces of the sheet are inverted and the sheet can be quickly deposited on a sheet stack on a stack support in a rapid and controlled manner. It was found however that after flipping deformation or damage to the leading edge portions of sheets could occur.

SUMMARY OF THE INVENTION

It is an object of the invention to provide an alternative method for stacking sheets which reduces or prevents damage to sheets.

In accordance with the present invention, a method according to claim 1, a sheet stacker according to claim 8, and a sheet printer according to claim 15 are provided. The method is a method for stacking sheets received from a printer by means of a sheet flipping device comprising at least one slot for receiving a leading portion of a sheet, which method comprises the steps of:

- determining a respective insertion depth parameter for a first and a second sheet, wherein the second sheet has a greater stiffness than the first sheet;
- inserting a length of the first sheet into at the least one slot in correspondence with its respective insertion depth parameter, followed by flipping said first sheet;
- inserting a length of the second sheet into at the least one slot in correspondence with its respective insertion depth parameter, followed by flipping said second sheet, wherein the inserted length of the first sheet is greater than that of the second sheet.

It is the insight of the inventors that the deformation of the leading portion occurred for sheets with a relatively high stiffness, while relatively weaker sheets underwent the stacking process without damage. The inventors further deduced that the deformation was due to the local bending of the leading portion of the stiffer sheets in the at least one slot of the flipping device during the flipping. The inventors had the further insight that this deformation could be prevented by inserting relatively stiffer sheets not fully into the at least one slot. Thereby, the deformation of the leading portion of stiffer sheets is reduced and/or prevented. It was found however that weaker sheets require a relatively deeper insertion into the at least one slot to properly hold them in place during flipping. In consequence, the inventors proposed a method wherein relatively stiffer sheets are inserted into the at least one slot at a shallower insertion depth than relatively weaker sheets. Thus, a wide range of print media sheets can be reliably stacked with a reduced risk of deformation. Thereby the object of the present invention has been achieved.

More specific optional features of the invention are indicated in the dependent claims.

In an embodiment, the method further comprises the step of selecting a media type for a print job, and comparing the selected media type to an insertion depth look-up table to determine the corresponding insertion depth parameter. The to be applied insertion depth of the sheets is automatically determined when a media type for a print job is input. The media type is compared to an insertion depth look-up table, wherein insertion depth parameters are defined or derivable for each media type. Thus, when a media type is selected, the corresponding insertion depth up to which a sheet of said media type is to be inserted into the at least one slot is automatically derived from the insertion depth look-up table. This allows for productive and/or unattended printing and stacking of sheets. It will be appreciated that the designated insertion depth is equal to the designated length of the sheet to be inserted into the at least one slot.

In an embodiment, the insertion depth look-up table is comprised in a media catalogue, wherein an insertion depth parameter has been designated for each media type. The media catalogue defines all relevant media types for use with the respective printer. Generally, such a media catalogue comprises information regarding sheet dimensions, materials, sheet processing parameters, etc. The media catalogue is extended to include an insertion depth parameter for each media type. The insertion depth parameter defines or can be used to derive the length by which a sheet of a certain media type is to be inserted into the at least one slot to avoid deformations in the sheet after flipping.

In an embodiment, the insertion depth of sheets is inversely proportional to their stiffness. The length by which relatively stiffer sheets are inserted into the at least one slot is smaller than the length by which relatively weaker sheets are inserted into the at least one slot. Inversely proportional can include any number of different insertion depths, including a binary division between weak and stiff media, wherein each media type is assigned to one of these two categories and inserted at one of two corresponding different insertion depths.

In an embodiment, the step of flipping the sheet comprises rotating a flipping wheel on which the at least one slot has been provided. The at least one slot is thereby rotated, inverting the sheet, which allows for high speed sheet stacking.

In an embodiment, the insertion depth is determined by controlling the relative velocities of the at least one slot and of the sheet as it is being inserted into the at least one slot. Different insertion depths can be achieved within a single slot by controlling the length by which a sheet is inserted. The insertion of the sheet is stopped when is respective insertion depth has been reached. The inserted length of the sheet is then equal to its designated insertion depth. Weaker media are inserted deeper into the at least one slot, while the insertion depth for stiffer media is relatively shallow.

In an embodiment, the flipping device is provided with two slots, having different depths in an insertion direction. Different insertion depths can also be achieved by two or more different slots having different sizes. Sheets can then be fully inserted into their respective slot while still allowing for different insertion depths. Upon insertion of a sheet of a certain media type, the slot with the corresponding insertion depth is rotated into a receiving position to receive said sheet.

The present invention further relates to a sheet stacker for stacking sheets of printed media, comprising:

a flipping device comprising at least one slot for receiving a leading portion of a sheet, such the sheet is flipped through a rotation of the slot;

a controller storing an insertion depth look-up table and configured to control the flipping device, such that an insertion depth (up) to which sheets of a relatively greater stiffness are inserted into at least one slot is less than an insertion depth (up) to which sheets of a relatively lesser stiffness are inserted into the at least one slot. The controller stores a set of insertion depth parameters in the insertion depth look-up table, which define for each media type the insertion depth up to which a sheet of said media type is to be inserted into the at least one slot to avoid deformation of said sheet after flipping. Upon selection of a certain media type for a print job, the controller derives the corresponding insertion depth from the insertion depth look-up table. The flipping device is then controlled, such that sheets of said media type are then inserted into the at least one slot up to a length equal to the insertion depth. The inserted length does not exceed the insertion depth. When a different media type is selected, the controller adjusts the insertion depth accordingly. In this manner, the controller ensures that relatively stiffer media are not inserted too deeply into the at least one slot to avoid deformations, while relatively weaker media types are inserted sufficiently deep to ensure a reliable flipping of these media types. This results in reliable and deformation-free sheet stacking.

In an embodiment, the controller is configured to receive print job information defining a media type via an user interface and to compare the defined media type to the insertion depth look-up table to determine an insertion depth parameter corresponding to a depth by which a sheet of said media type is to be inserted in the at least one slot, and to control the sheet flipping device to insert the sheet of said media type at said depth into the at least one slot. From the input print job information the controller determines the media type for the print job. From the media type, the corresponding insertion depth is derived. In consequence, the workload of the operator is reduced.

In an embodiment, the insertion depth look-up table is comprised in a media catalogue stored on the controller's memory. The controller generally stores a media catalogue defining various parameter or properties of print media types which can be used in the printer. The media catalogue has been extended to include an insertion depth parameter for each of the media types defined in the catalogue. The insertion depth parameter may be expressed as the length by which the sheet is to inserted, or any other suitable parameter from which the insertion depth can be derived, such as stiffness, rigidity, elasticity related parameters.

In an embodiment, the sheet flipping device comprises a rotatable flipping wheel upon which the at least one slot has been provided. In another embodiment, the sheet flipping device further comprises a stop element positioned, such that when contacting the stop element the sheet is released from the at least one slot.

In an embodiment, the sheet flipping device comprises an insertion device, and wherein the controller is configured to control the relatively velocities of the at least one slot and the insertion device to control the depth by which the sheet is inserted into the at least one slot. The insertion depth can varied by controlling how deep a sheet is inserted into the at least one slot. Weaker sheets are for example inserted fully into a slot, while stiffer sheets are only inserted halfway into the slot or less (halfway herein being defined with respect to the total length of the slot).

In an embodiment, the sheet flipping device comprises a pair of slots, wherein the slots have different depths in an insertion direction of the sheet. Different insertion depth can also be achieved by providing different slots on the flipping wheel, wherein each slot has a different total length. The total length of the slot in this case defines the insertion depth. Weaker sheets are fully inserted into a longer or deeper slot, while stiffer sheets are inserted into a smaller or shallower slot.

The present invention further relates to a sheet printer comprising a sheet stacker as described above. The printer is preferably an inkjet printer.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
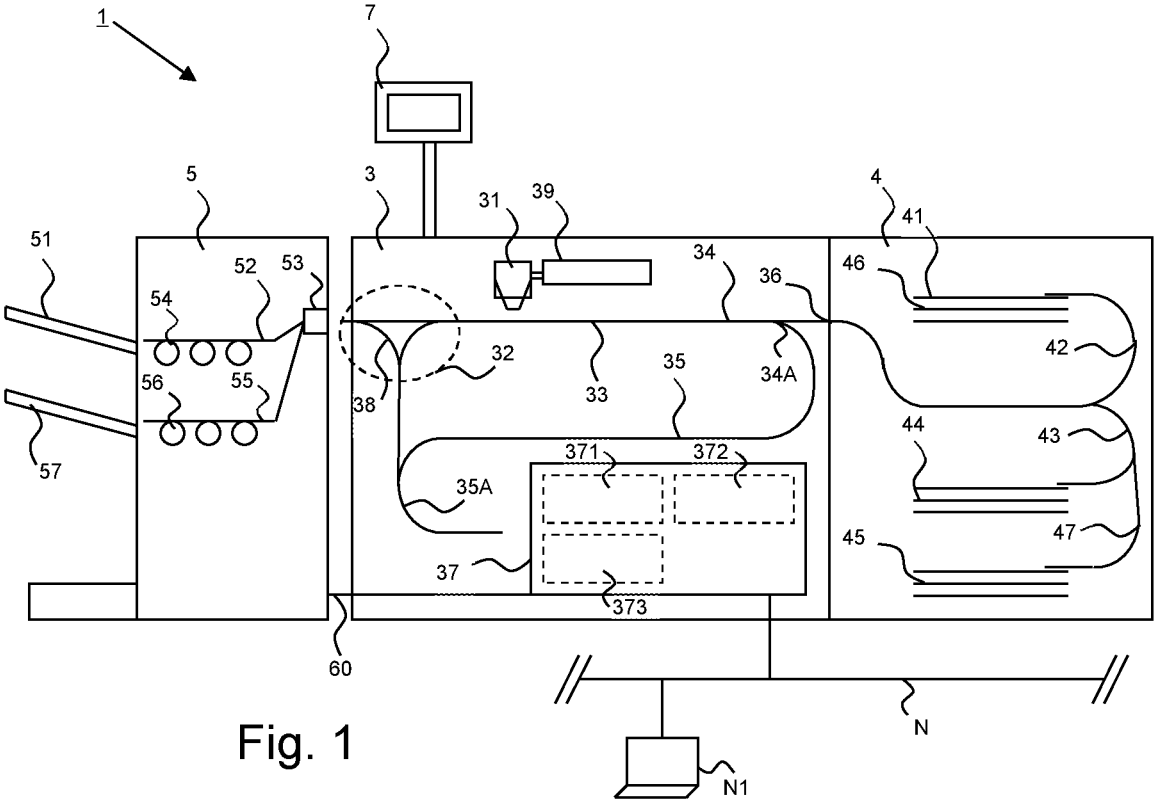
FIG. 1 is a schematic side view of an inkjet sheet printer.

The present invention will now be described with reference to the accompanying drawings, wherein the same reference numerals have been used to identify the same or similar elements throughout the several views.

FIG. 1 shows schematically an embodiment of a printing system 1 according to the present invention. The printing system 1, for purposes of explanation, is divided into an output section 5, a print engine and control section 3, a local user interface 7 and an input section 4. While a specific printing system is shown and described, the disclosed embodiments may be used with other types of printing system such as an ink jet print system, an electrographic print system, etc.

The output section 5 comprises a first output holder 52 for holding printed image receiving material, for example a plurality of sheets. The output section 5 may comprise a second output holder 55. While 2 output holders are illustrated in FIG. 1, the number of output holders may include one, two, three or more output holders. The printed image receiving material is transported from the print engine and control section 3 via an inlet 53 to the output section 5. When a stack ejection command is invoked by the controller 37 for the first output holder 52, first guiding means 54 are activated in order to eject the plurality of sheets in the first output holder 52 outwards to a first external output holder 51. When a stack ejection command is invoked by the controller 37 for the second output holder 55, second guiding means 56 are activated in order to eject the plurality of sheets in the second output holder 55 outwards to a second external output holder 57.

The output section 5 is digitally connected by means of a cable 60 to the print engine and control section 3 for bi-directional data signal transfer.

The print engine and control section 3 comprises a print engine and a controller 37 for controlling the printing process and scheduling the plurality of sheets in a printing order before they are separated from input holder 44, 45, 46.

The controller 37 is a computer, a server or a workstation, connected to the print engine and connected to the digital environment of the printing system, for example a network N for transmitting a submitted print job to the printing system 1. In FIG. 1 the controller 37 is positioned inside the print engine and control section 3, but the controller 37 may also be at least partially positioned outside the print engine and control section 3 in connection with the network N in a workstation N1.

The controller 37 comprises a print job receiving section 371 permitting a user to submit a print job to the printing system 1, the print job comprising image data to be printed and a plurality of print job settings. The controller 37 comprises a print job queue section 372 comprising a print job queue for print jobs submitted to the printing system 1 and scheduled to be printed. The controller 37 comprises a sheet scheduling section 373 for determining for each of the plurality of sheets of the print jobs in the print job queue an entrance time in the paper path of the print engine and control section 3, especially an entrance time for the first pass and an entrance time for the second pass in the loop in the paper path according to the present invention. The sheet scheduling section 373 will also be called scheduler 373 hereinafter.

The sheet scheduling section 373 takes the depth of the loop into account. The depth of the loop corresponds to a loop time duration of a sheet going through the loop dependent on the velocity of the sheets in the loop. The loop time duration may vary per kind of sheet, i.e. a sheet with different media properties.

Resources may be recording material located in the input section 4, marking material located in a reservoir 39 near or in the print head or print assembly 31 of the print engine, or finishing material located near the print head or print assembly 31 of the print engine or located in the output section 5 (not shown).

The paper path comprises a plurality of paper path sections 32, 33, 34, 35 for transporting the image receiving material from an entry point 36 of the print engine and control section 3 along the print head or print assembly 31 to the inlet 53 of the output section 5. The paper path sections 32, 33, 34, 35 form a loop according to the present invention. The loop enables the printing of a duplex print job and/or a mix-plex job, i.e. a print job comprising a mix of sheets intended to be printed partially in a simplex mode and partially in a duplex mode.

The print head or print assembly 31 is suitable for ejecting and/or fixing marking material to image receiving material. The print head or print assembly 31 is positioned near the paper path section 34. The print head or print assembly 31 may be an inkjet print head, a direct imaging toner assembly or an indirect imaging toner assembly.

While an image receiving material is transported along the paper path section 34 in a first pass in the loop, the image receiving material receives the marking material through the print head or print assembly 31. A next paper path section 32 is a flip unit 32 for selecting a different subsequent paper path for simplex or duplex printing of the image receiving material. The flip unit 32 may be also used to flip a sheet of image receiving material after printing in simplex mode before the sheet leaves the print engine and control section 3 via a curved section 38 of the flip unit 32 and via the inlet 53 to the output section 5. The curved section 38 of the flip unit 32 may not be present and the turning of a simplex page has to be done via another paper path section 35.

In case of duplex printing on a sheet or when the curved section 38 is not present, the sheet is transported along the loop via paper path section 35A in order to turn the sheet for enabling printing on the other side of the sheet. The sheet is transported along the paper path section 35 until it reaches a merging point 34A at which sheets entering the paper path section 34 from the entry point 36 interweave with the sheets coming from the paper path section 35. The sheets entering the paper path section 34 from the entry point 36 are starting their first pass along the print head or print assembly 31 in the loop. The sheets coming from the paper path section 35 are starting their second pass along the print head or print assembly 31 in the loop. When a sheet has passed the print head or print assembly 31 for the second time in the second pass, the sheet is transported to the inlet 53 of the output section 5.

The input section 4 may comprise at least one input holder 44, 45, 46 for holding the image receiving material before transporting the sheets of image receiving material to the print engine and control section 3. Sheets of image receiving material are separated from the input holders 44, 45, 46 and guided from the input holders 44, 45, 46 by guiding means 42, 43, 47 to an outlet 36 for entrance in the print engine and control section 3. Each input holder 44, 45, 46 may be used for holding a different kind of image receiving material, i.e. sheets having different media properties. While 3 input holders are illustrated in FIG. 1, the number of input holders may include one, two, three or more input holders.

The local user interface 7 is suitable for displaying user interface windows for controlling the print job queue residing in the controller 37. In another embodiment a computer N1 in the network N has a user interface for displaying and controlling the print job queue of the printing system 1.

Sheet Stacker

Figure 2:
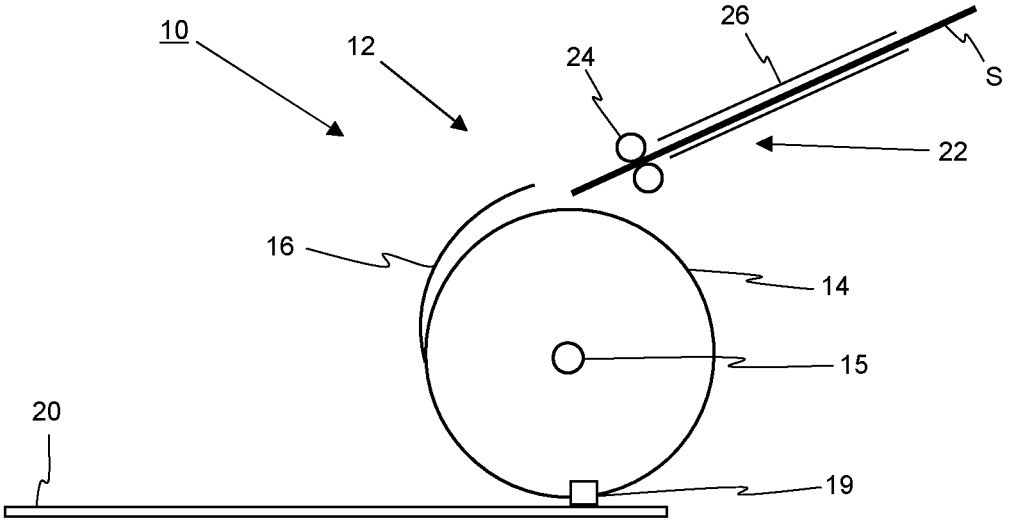
FIG. 2 is a schematic side view of a sheet stacker for the inkjet sheet printer in FIG. 1 while receiving a sheet.

FIG. 2 illustrates a sheet stacker 10 comprising a sheet flipping device 12 for forming a stack of sheets S on a stack support 20. The general operation of such a sheet stacker 1 will be explained in FIGS. 2 to 5.

The sheet flipping device 12 comprises a flipping wheel 14 rotatably provided around a rotation axis 15. A drive (not shown) is provided to rotate the flipping wheel 14. At least one slot 16 is provided on the circumference of the flipping wheel 14. The slot 16 is fixed with respect to the flipping wheel 14, such that it rotates when the flipping wheel 14 is rotated by its drive. The slot 16 is configured to hold a leading portion of a sheet S. The sheet S is supplied from an inserting device 22. The inserting device 22 comprises a transport path extending towards the slot 16, when in the receiving position shown in FIG. 2. The inserting device in FIG. 2 comprises guide plates 26 to guide the sheet S towards the inserting pinch 24. The inserting pinch 24 is formed of a pair of rollers, at least one of which is provided with a drive. Since the rollers of the inserting 24 are pressed together, rotation of the driven roller transports the sheet S towards the slot 16 in a controlled manner.

Figure 3:
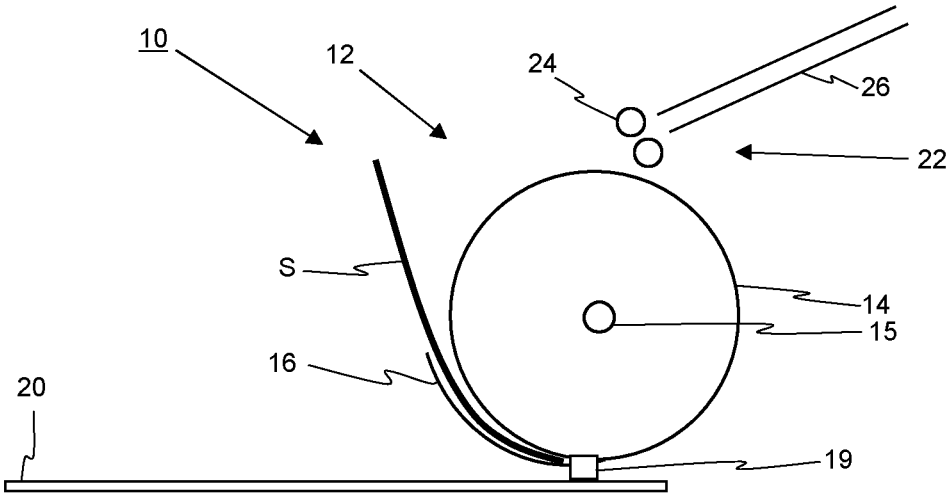
FIG. 3 is a schematic side view of a sheet stacker for the inkjet sheet printer in FIG. 1 while flipping a sheet.
Figure 4:
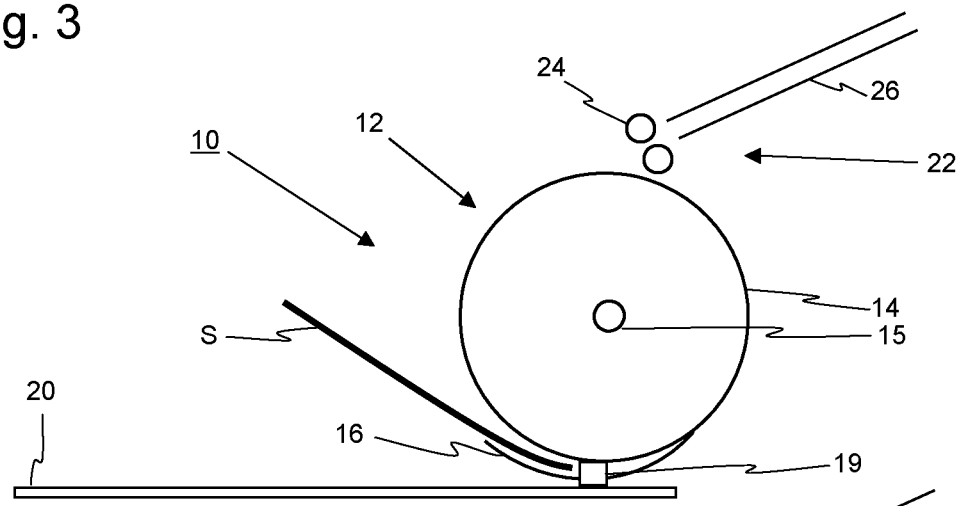
FIG. 4 is a schematic side view of a sheet stacker for the inkjet sheet printer in FIG. 1, while releasing a sheet from a slot.

When the leading portion of the sheet S has been received in the slot 16, the flipping wheel 14 is rotated, a shown in FIG. 3. This results in a flipping motion of the sheet S, wherein the trailing portion of the sheet S rolls out beyond the flipping wheel 14. After having passed through a predetermined angle, the leading edge of the sheet S contacts one or more stop elements 19 adjacent the flipping wheel 14. The one or more stop elements 19 are positioned such that the flipping wheel 14 and the slot 16 can pass by the stop elements 19, while the leading edge of the sheet S is prevented from further passage. In consequence, as shown in FIG. 4, the leading portion of the sheet S is released from the slot 16 by the continued rotation of the flipping wheel 14. The slot 16 is returned to its receiving position for receiving a subsequent sheet. The sheet S completes its flipping motion and is thereby deposited on the stack support 20 (or on a top sheet of a stack already present thereon), as shown in FIG. 5.

Figure 5:
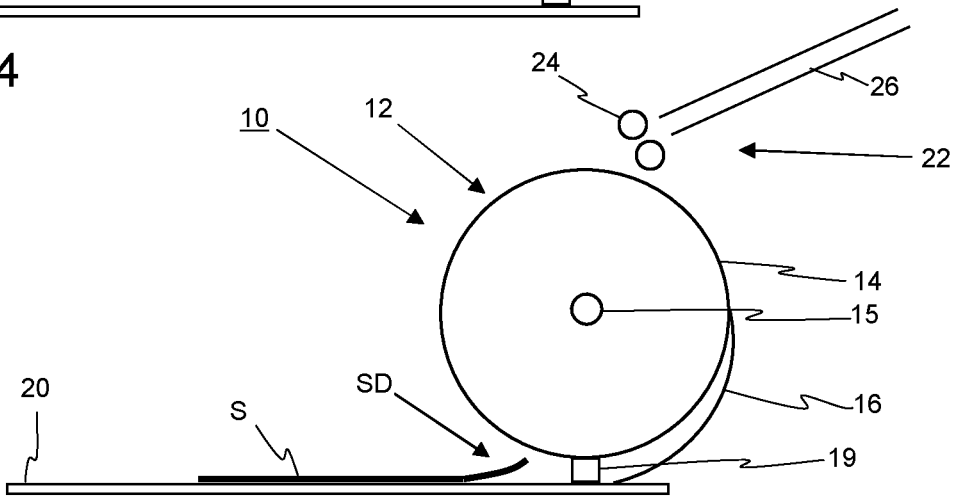
FIG. 5 is a schematic side view of a sheet stacker for the inkjet sheet printer in FIG. 1, after flipping the sheet using a stacking method as known in the prior art.

It was found that when flipping sheets of stiffer media types, deformations SD were present in the sheet S after flipping, as shown in FIG. 5. It was found that these deformations resulted from the residency of the leading portion in the slot 16. To counteract this damage to the sheet S, the inventors varied the insertion depth D1, D2 by which the leading portion of the sheet S is inserted into the slot 16 based on the sheets' stiffness.

Figure 6:
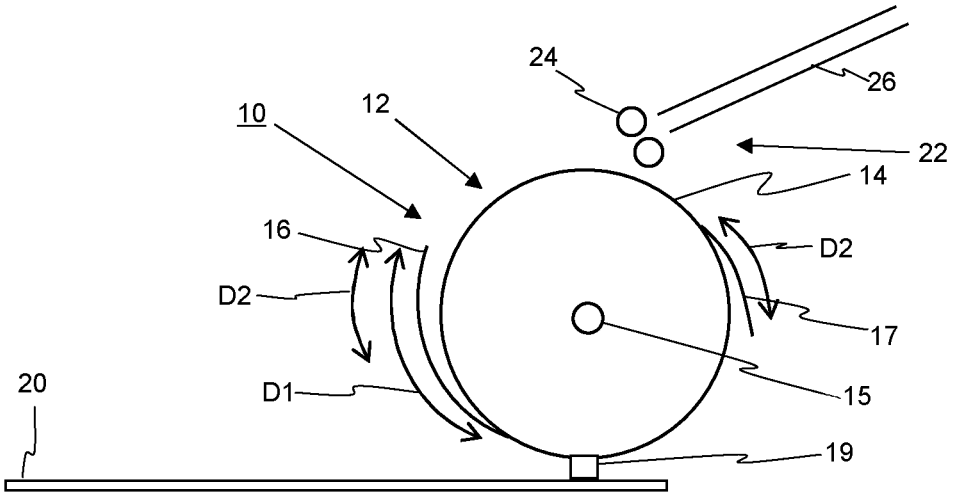
FIG. 6 is a schematic side view of an embodiment sheet stacker for the inkjet sheet printer in FIG. 1, illustrating different insertion depths.

As illustrated in FIG. 6, different insertion depths are defined for sheets S of different stiffness. The insertion depth D1, D2, is measured from the entry point at the open end of the slot 16, 17 in the insertion direction of the sheet S into the slot 16, 17. The insertion direction corresponds to the circumferential direction wherein the flipping wheel 14 is rotated during flipping. The first insertion depth D1, which is greater than the second insertion depth D2, is assigned to sheets S of relatively low stiffness. These weak and/or flexible sheets S can be inserted deeply into the slot 16, for example into the substantially full depth of the slot 16, without the risk of deformation, to ensure a reliable holding during flipping. Sheets S with a substantially greater stiffness are designated to be inserted to the second insertion depth D2. The insertion depth D2 for relatively stiffer sheets S is significantly smaller than the insertion depth D1 for relatively weaker sheets S. This prevents deformation of the stiffer sheets S.

FIG. 6 illustrates the two manners of inserting sheets at different insertion depths D1, D2 dependent on the sheet stiffness. Different insertion depths D1, D2 can be applied to the same slot 16 by controlling the insertion of the sheet S by the inserting device 22 into the slot 16. The controller 37 determines a measure of the stiffness of the sheet S to be used from print job information input to the controller 37 via the user interface 7, which can be on the printer 1 and/or or on a workstation N1 connected to the network N. The print job information triggers a media type selection, wherein one of a plurality of media types stored in a media catalogue is selected. Additionally, an insertion depth for the to be used media type is determined by the controller 37. The media catalogue may comprise for example a look-up table (28 in FIG. 7), which relates insertion depths D1, D2 to media types, or which derives an insertion depth based on a stiffness parameter assigned for each media type. The look-up table 28 may be in any suitable format, such as a classic row-by-column table, matrix, formula, graph, etc. When the insertion depth D1, D2 has been determined, the controller 37 controls the velocities and/or timings of the sheet insertion by inserting device 22 into the slot 16. A weaker sheet S is inserted into the slot 16 to the insertion depth D1, while a stiffer sheet S is inserted only partially in the slot 16. The insertion depth D1, D2 is determined by controlling the drive of the inserting pinch 24. The inserting pinch 24 is stopped when the insertion depth D1, D2 has been reached, even if the sheet S has not yet reached the end of the slot 16. The drive of the flipping wheel 14 is then activated and the sheet S is flipped. Stiffer sheets S are flipped while only partially, e.g. no more than halfway, inserted into the slot 16 to avoid deformations SD. Weaker sheets S substantially fill the slot 16 in the insertion direction during flipping, until they are released. It will appreciated that the above described insertion operation can also be performed while the flipping wheel 14 rotates by adjusting the velocity and timing of the inserting pinch accordingly.

FIG. 6 further illustrates that different insertion depths D1, D2 can be achieved by providing two slots 16, 17 with different slot depths on the flipping wheel 14. When the controller 37 determines that the to be stacked sheet S has a relatively high stiffness, it rotates the flipping wheel such that the smaller slot 17 is in the receiving position, when said sheet S is present in the inserting device 22. The stiffer sheet S is then inserted into the smaller slot 17, which has a relatively small insertion depth D2. When a relatively weaker sheet S has been selected for use, the controller 37 rotates the larger slot 16 into the receiving position, when the weaker sheet S is at the inserting device 22. The insertion depth D2 of the larger slot 16 is greater than that of the other slot 17. In consequence, the inserted length of the weaker sheet S in the larger slot 16 is greater than that of the stiffer sheet S in the smaller slot 17. Thus, different insertion depths D1, D2 can be achieved by differently formed slots 16, 17 and/or controlling the level of insertion into a single slot 16.

Figure 7:
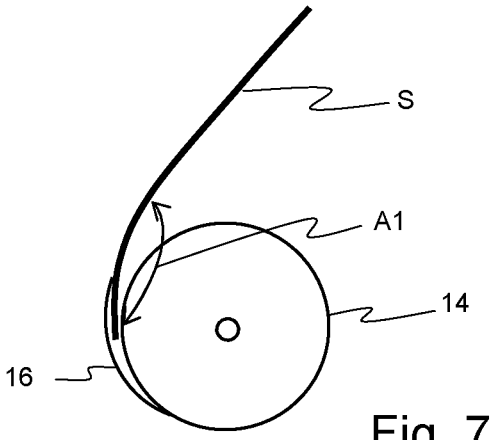
FIG. 7 is a schematic side view of a sheet being flipping in the sheet stacker in FIG. 2.
Figure 8:
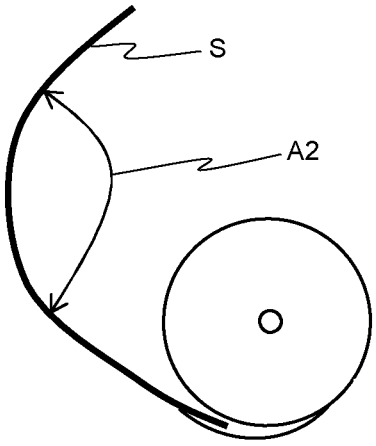
FIG. 8 is a schematic side view of a sheet being flipping further in the sheet stacker in FIG. 2.

FIG. 7 illustrates the advantage of inserting a stiff sheet S only partially into the slot 16. The partial insertion ensures that the radius of curvature A1 at the leading portion of the sheet S remains relatively large. This prevents deformation of the leading portion. Additionally, FIG. 8 shows that in this manner the radius of curvature A2 of the sheet S during flipping also remains relatively large. By avoiding smaller radii of curvature permanent deformation of the sheet S is avoided.

Figure 9:
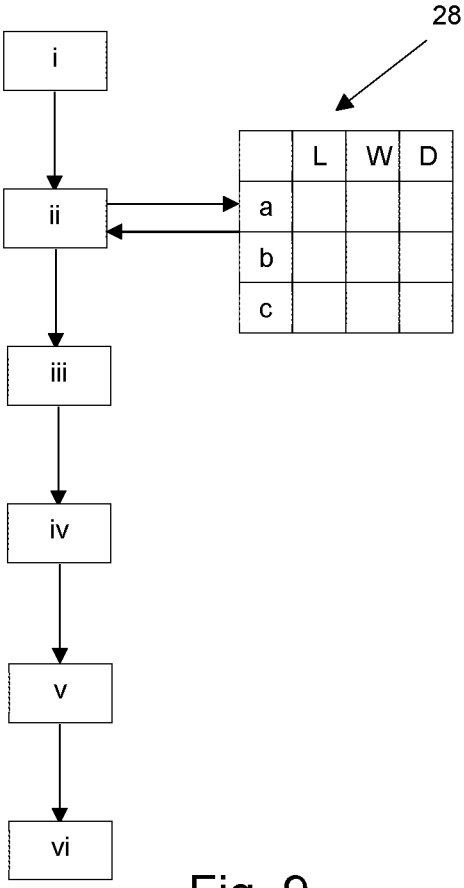
FIG. 9 is a block diagram illustrating the steps of stacking a sheet.

FIG. 9 illustrates the steps of the method according to the present invention. In step i, print job information is submitted to the controller 37, from which the controller 37 determines which media type is to be applied for the corresponding print job. Said media type is then selected by the controller 37 from the media catalogue. In step ii, the selected media type is compared to the insertion depth look-up table 28 to determine the insertion depth D1, D2 corresponding to the selected media type. It will be appreciated that step i and ii can be combined into a single step by incorporating the insertion depth look-up table 28 into the media catalogue. The insertion depth look-up table 28 in FIG. 7 comprises different rows a-c, each of which is designated to a specific media type. For each row a-c, several parameters relating to the media type are stored in the insertion depth look-up table 28. In the example in FIG. 7, each row a-c defines the length L, width W, and the insertion depth parameter D. The insertion depth parameter D may be expressed in any suitable format, such as an insertion depth D1, D2 in mm or cm, designation to one of the slots 16, 17, a release timing for inserting device 22 in ms or s, etc. The insertion depth parameter D may also be a measure for the stiffness or rigidity of the media type, from which the insertion depth D1, D2 can be derived by a formula, table, or graph stored on the controller 37. Therein, the length L and width W of the media type may be taken into account.

In step iii, a sheet S of the selected media type arrives at the inserting device 22. In step iv, the controller 37 controls the inserting device 22 and/or the flipping wheel 14 to insert the sheet S at the determined insertion depth D1, D2. The sheet S is inserted such that the inserted length matches the insertion depth D1, D2. In step v, the controller 37 controls the flipping wheel 14 to rotate with the sheet S inserted at the corresponding insertion depth D1, D2. Thereby, the sheet S is flipped to begin forming a stack on the stack support 20. Steps iii to v are repeated until the controller 37 in step vi determines that a different media type is selected for an upcoming print job. The controller 37 then executes step ii to determine a new insertion depth D1, D2 corresponding to this different media type before proceeding with steps iii to v to form a subsequent sheet stack.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for stacking sheets received from a printer by a sheet flipping device comprising at least one slot for receiving a leading portion of a sheet, the method comprising the steps of:

determining a respective insertion depth parameter for a first sheet and a second sheet, wherein the second sheet has a greater stiffness than the first sheet;

inserting a length of the first sheet into the at least one slot in correspondence with a first respective insertion depth parameter thereof, followed by flipping said first sheet; and inserting a length of the second sheet into the at least one slot in correspondence with a second respective insertion depth parameter thereof, followed by flipping said second sheet, wherein the inserted length of the first sheet is greater than the inserted length of the second sheet.

2. The method according to claim 1, further comprising the steps of:

selecting a media type for a print job; and comparing the selected media type to an insertion depth look-up table to determine the corresponding insertion depth parameter.

3. The method according to claim 2, wherein the insertion depth look-up table is comprised in a media catalogue, wherein an insertion depth parameter has been designated for each media type.

4. The method according to claim 3, wherein the inserted depth of a sheet is inversely proportional to a stiffness of the sheet.

5. The method according to claim 1, wherein the step of flipping the sheet comprises rotating a flipping wheel on which the at least one slot has been provided.

6. The method according to claim 1, wherein the inserted depth is determined by controlling relative velocities of the at least one slot and of the sheet as the sheet is being inserted into the at least one slot.

7. The method according to claim 1, wherein the flipping device is provided with two slots, having different depths in an insertion direction.

8. A sheet stacker for stacking sheets of printed media, comprising:

a flipping device comprising at least one slot for receiving a leading portion of a sheet, such that the sheet is flipped through a rotation of the at least one slot; and a controller storing an insertion depth look-up table and configured to control the flipping device, such that an insertion depth to which sheets of a relatively greater stiffness are inserted into the at least one slot is less than an insertion depth to which sheets of a relatively lesser stiffness are inserted into the at least one slot.

9. The sheet stacker according to claim 8, wherein the controller is configured to receive print job information defining a media type via a user interface and to compare the defined media type to the insertion depth look-up table to determine an insertion depth parameter corresponding to a depth to which a sheet of said media type is to be inserted in the at least one slot, and to control the sheet flipping device to insert the sheet of said media type at said depth into the at least one slot.

10. The sheet stacker according to claim 9, wherein the insertion depth look-up table is comprised in a media catalogue stored on a memory of the controller.

11. The sheet stacker according to claim 8, wherein the sheet flipping device comprises a rotatable flipping wheel upon which the at least one slot has been provided.

12. The sheet stacker according to claim 11, wherein the sheet flipping device further comprises a stop element positioned, such that by contacting the stop element the sheet is released from the at least one slot.

13. The sheet stacker according to claim 11, wherein the sheet flipping device comprises an insertion device, and wherein the controller is configured to control relatively velocities of the at least one slot and the insertion device to control the depth by which the sheet is inserted into the at least one slot.

14. The sheet stacker according to claim 11, wherein the sheet flipping device comprises a pair of slots, wherein the slots have different depths in an insertion direction of the sheet.

15. A sheet printer comprising the sheet stacker according to claim 8.

* * * * *